US005717188A

United States Patent [19]

Vaillancourt

[11] Patent Number: 5,717,188

[45] Date of Patent: Feb. 10, 1998

[54] SAFETY DEVICE FOR A HEATING APPLIANCE

[76] Inventor: Alain Vaillancourt, 29, Place des Bourgeois, Charlesbourg, Quebec, Canada, G2N 1W8

[21] Appl. No.: 489,928

[22] Filed: Jun. 12, 1995

[51] Int. Cl.[6] ..... H05B 3/68

[52] U.S. Cl. ..... 219/452; 219/453

[58] Field of Search ..... 219/451, 452, 219/453, 509, 518; 304/573

[56] References Cited

U.S. PATENT DOCUMENTS

| | | | |
|---|---|---|---|
| 4,179,691 | 12/1979 | Keller | 340/567 |
| 4,461,977 | 7/1984 | Pierpoint et al. | 315/159 |
| 4,775,913 | 10/1988 | Ekblad | 219/452 |
| 5,243,172 | 9/1993 | Hazan et al. | 219/452 |
| 5,357,170 | 10/1994 | Luchaco et al. | 315/159 |
| 5,380,983 | 1/1995 | Cavada et al. | 219/250 |

*Primary Examiner*—Teresa J. Walberg
*Assistant Examiner*—Sam Paik

[57] ABSTRACT

There is provided a safety device for electric stoves and ovens wherein there is provided a sensor for sensing when the stove is heating at a certain rate which could constitute a safety hazard and a sensing means for detecting the presence of a person within a predetermined area proximate the stove. When a certain period of time passes without motion by a person in the predetermined area while the stove is in the predetermined operating condition, power to the stove can be reduced.

7 Claims, 4 Drawing Sheets

Fig. 1
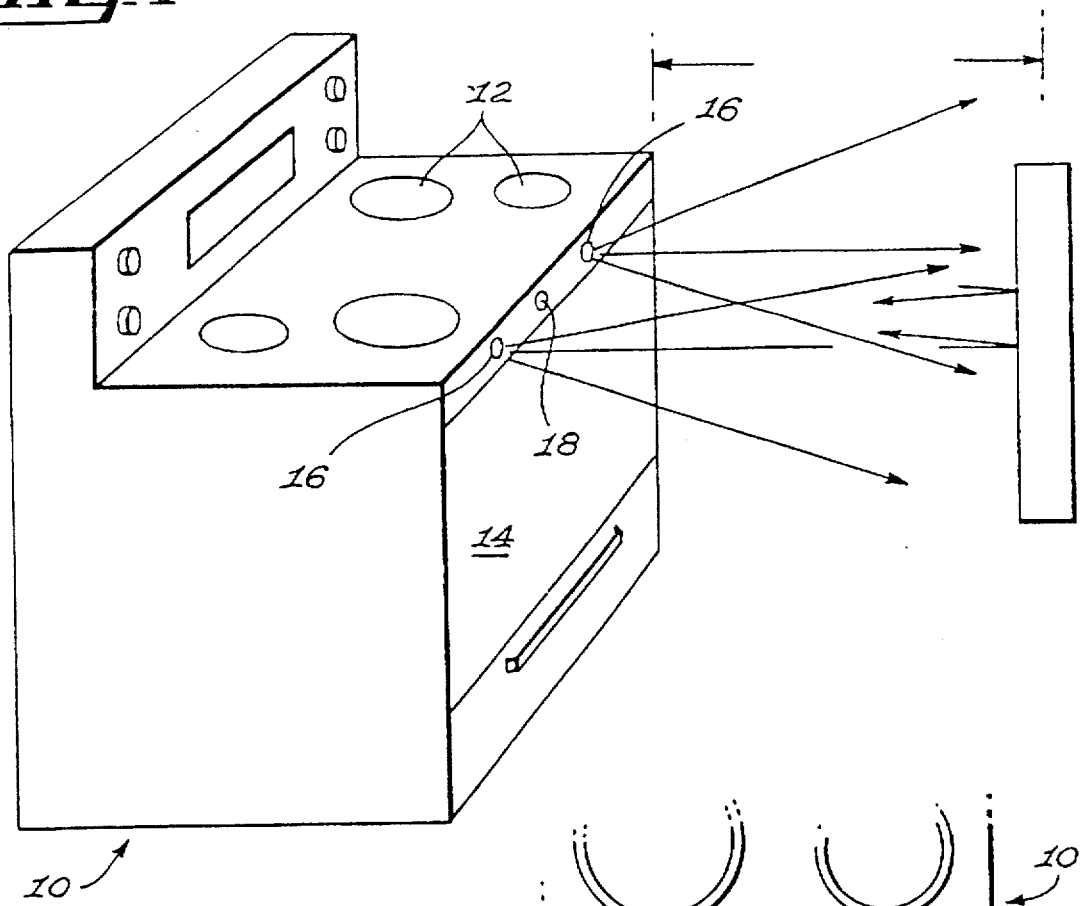
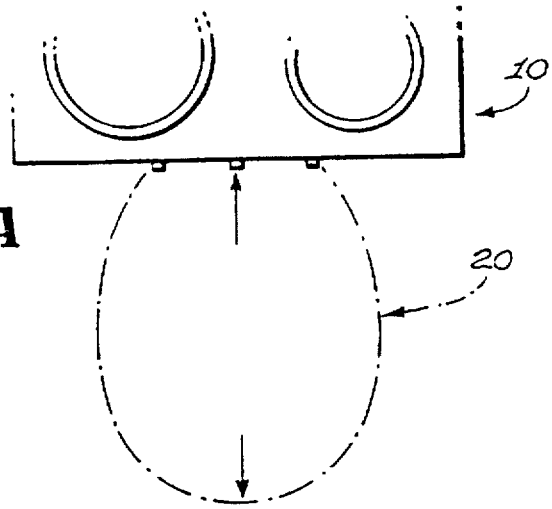
Fig. 1A
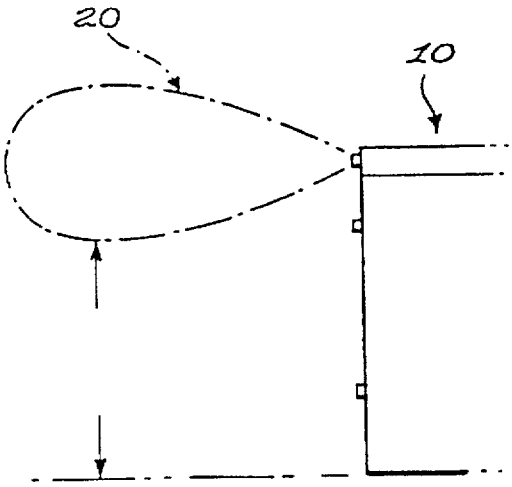
Fig. 1B

SAFETY DEVICE FOR A HEATING APPLIANCE

The present invention relates to a safety device for a heating appliance.

Electric stoves and ovens are examples of heating appliances widely used in today's society and each year there are a number of fires which occur as a result of stoves or ovens being left on at an overly high temperature. Often these fires result fom the negligence of the building occupant in turning on a stove and subsequently forgetting that it is on. As a result, materials like oils can catch fire and result in considerable loss of property and even life. Obviously, it would be desirable to incorporate a safety device with a stove top or oven to prevent such occurences.

The prior art teaches a plurality of temperature controls which are adapted to maintain a cooking element (often an oven) at a constant temperature. U.S. Pat. No. 3,686,476 Scahauer teaches a system which is adapted to turn off a self-cleaning oven when an excessive temperature is reached and/or cooling fan failure occurs. This system is limited to self-cleaning ovens and does not provide any protection against a fire danger with respect to a stove top arrangement.

Canadian patent 1,152,139 discloses another type of cut off device which is adapted to be used in an oven. The device is based on a change of surface texture of an item cooking in the oven.

It is an object of the present invention to provide a safety device which functions to reduce the heat output of a heating appliance when certain preset conditions are not met.

It is further object of the present invention to provide a safety device suitable for use with a cooking appliance wherein the power is cut off when a predetermined current and absence of motion is detected.

A further object of the present invention is to provide a safety device for a stove top or oven which can utilized with commercially available models without substantial modification thereto.

It is a further object of the present invention to provide a safety device which can be incorporated inside a stove at the factory.

According to one aspect of the present invention, there is provided a safety device for a heating apparatus, the device comprising first sensing means for sensing the presence of a person within a predetermined area, second sensing means for sensing an operational condition of the heating apparatus, and a means for reducing heat output from said apparatus after said second sensing means senses a predetermined operational condition and said first sensing means fails to sense the presence of a person within said predetermined area for a predetermined period of time.

In greater detail, the device of the present invention uses at least two different sensing devices which, when certain conditions occur, operate to send a signal to means for reducing the heat output from the apparatus.

The present invention will be described in terms of a conventional residential electric stoves although it will be understood that one knowledgeable in the art can equally well incorporate the invention in other types of heating apparatuses such as gas stoves, other gas heaters, electrical heaters, etc.

In general terms, the first sensing menas are adapted to detect the presence of a person within a predetermined area. The predetermined area would normally be in the general location of the stove and the sensing means is used in conjuction with a timer. Thus, as long as there is movement proximate the stove within certain time delays, the stove will continue to function in a normal manner. However, when the sensing means fails to detect motion for a certain period of time; then the first predetermined condition is established for reducing the heat output from the apparatus or appliance.

The means for sensing the movement may be any appropriate and known in the art. Thus, one could utilize various types of motions detectors including, ultrasonic, magnetic, infrared and the like. Such sensors are well known in the art and commercially available.

The period of time required to cause the first predetermined condition to be met can be varied. Thus, the period of time could vary depending upon the location, particular circumstances, etc. Normally, a delay of between two to seven minutes would be appropriate. The system could include means for varying the time such that the user could, under certain conditions, set it to shorter time periods when appropriate.

The second sensing means is also used to sense various operational conditions. These conditions could range from certain temperature values to other analogue measurements such as electric current flow, gas flow, etc. For exemple, in the case of an electric stove, one could measure the electric current output to a given burner and when this output is in excess of a given value, and in conjunction with the predetermined condition of the first sensing means being met will function to reduce the heat output. Again, by way of an example, one could, in the case of an electric stove, decide that any heat over a medium setting would be sufficient to meet the second predetermined condition.

As mentionned, the second sensing means for detecting an the operational condition of the heating apparatus mat vary between those such as electric current detection, heat detection, etc.

When the predetermined conditions are met (no motion within a certain time period and the operational condition), the apparatus will function to reduce the heat output. Depending upon the type of system employed, this may vary from reducing the electrical power to the heating apparatus through various known means to the step of cutting all power thereto. It will be understood that suitable means to reduce heat output are well known to those skilled in the art.

In conjunction with the above, various alarm means and the like may be employed. These alarm means can include both audio and visual alarms and combinations thereof.

In a preferred embodiment, the device is used in conjunction with an electric stove and is connected to be operational both for the normal stove top heating elements and for the oven. For the stove top elements, one would employ a predetermined time delay of between 5 to 10 minutes and with a heat setting on any of the elements over a medium or medium low setting. If motion were not detected within this time period, an alarm would be activated to permit a person to verify the stove top conditions. Following a period further of time (30 seconds–2 minutes), power would be cut to the stove top. In order to continue heating, a reset mechanism could be used.

In the case of the oven, it is understood that many cooking conditions require a long period of time and continual verification is not required. However, there are certain conditions which are more dangerous including, for example, the use of the upper element in the oven for broiling. Accordingly, one could utilize a mechanism which would be activated only when, for example, the broil element is utilized and/or a certain temperature is achieved.

Having thus generally described the invention, reference will be made to the accompanying drawings illustrating an embodiment thereof, in which:

FIG. 1 is a perspective view of a electric stove embodying the safety device of the present invention;

FIG. 1A is a top view illustrating the range of operation of the sensing device;

FIG. 1B is a side view illustrating operation of the sensing device;

Figure 2:
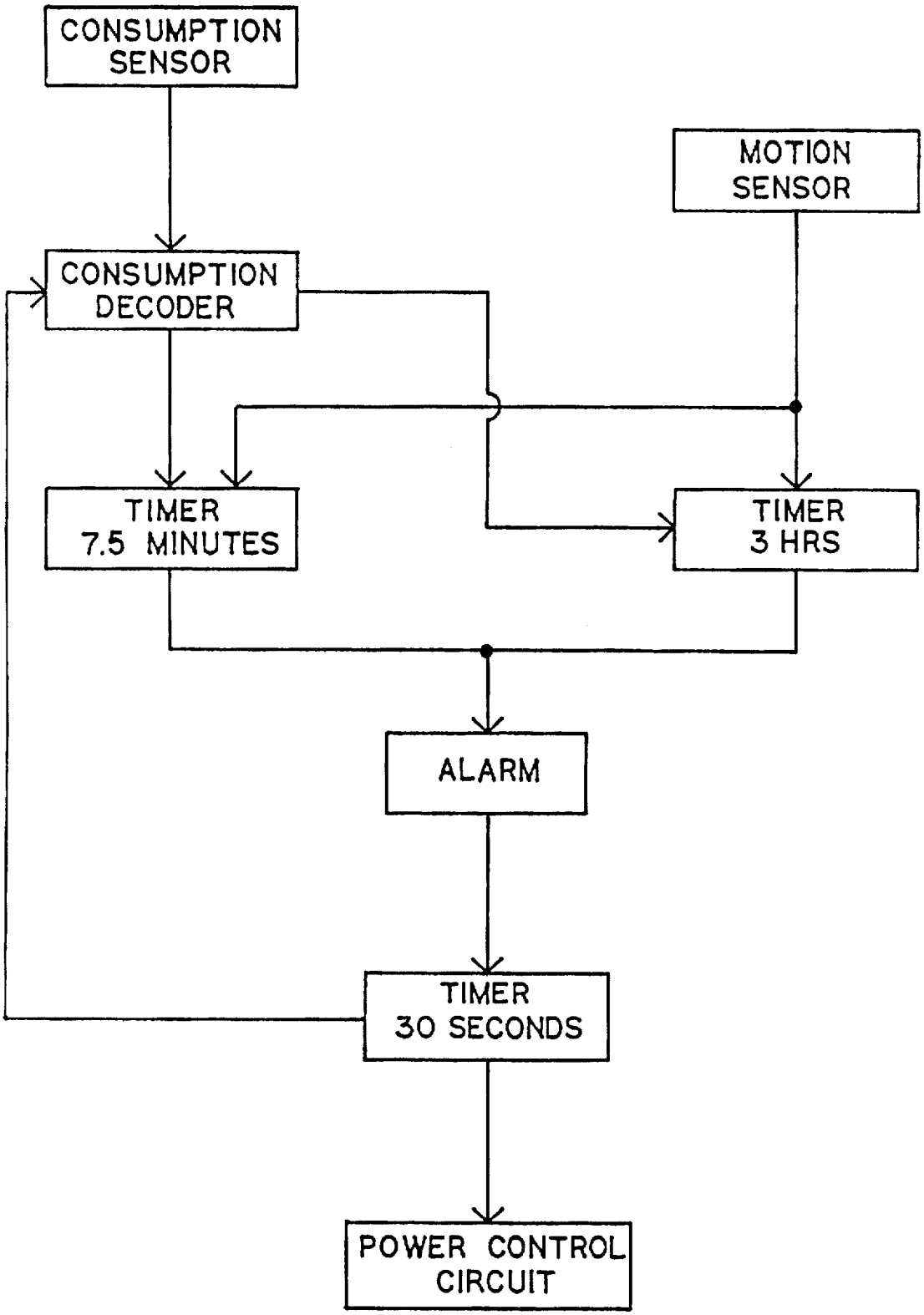
FIG. 2 is a block diagram illustrating the logic.

Referring to the drawings in greater detail and by reference characters thereto, there is illustrated in FIGS. 1, 1A and 1B a conventional stove which includes a plurality of heating elements 12 and an oven section generally designated by reference numeral 14. On a front panel, there are provided a pair of infrared emitters 16 and a infrared receptor 18. Emitters 16 are adapted to emit an infrared signal in a pattern which has a generally tear drop pattern 20 as shown in FIGS. 1A and 1B. Pattern 20 would normally extend outwardly a distance of between 3 to 7 feet and as noted, does not cover a lower area near the floor to thereby prevent false signals being given by animals or the like.

Operation of the invention is illustrated in FIG. 2 which, as shown, includes a first sensor 22 which may sense the consumption of power by the electric stove. Sensor 22 is operatively connected to a decoder 24 which in turn provides a signal to a first timer 26 and a second timer 28. A motion sensor 30 also inputs to both timers 26 and 28.

When both predetermined conditions are met (lack of motion for a period of time and a predetermined consumption level), an alarm 32 is activated. Alarm 32 in turn inputs to a third timer 34 following which a signal is provided to power control circuit 36 to cut off the power.

Figure 3:
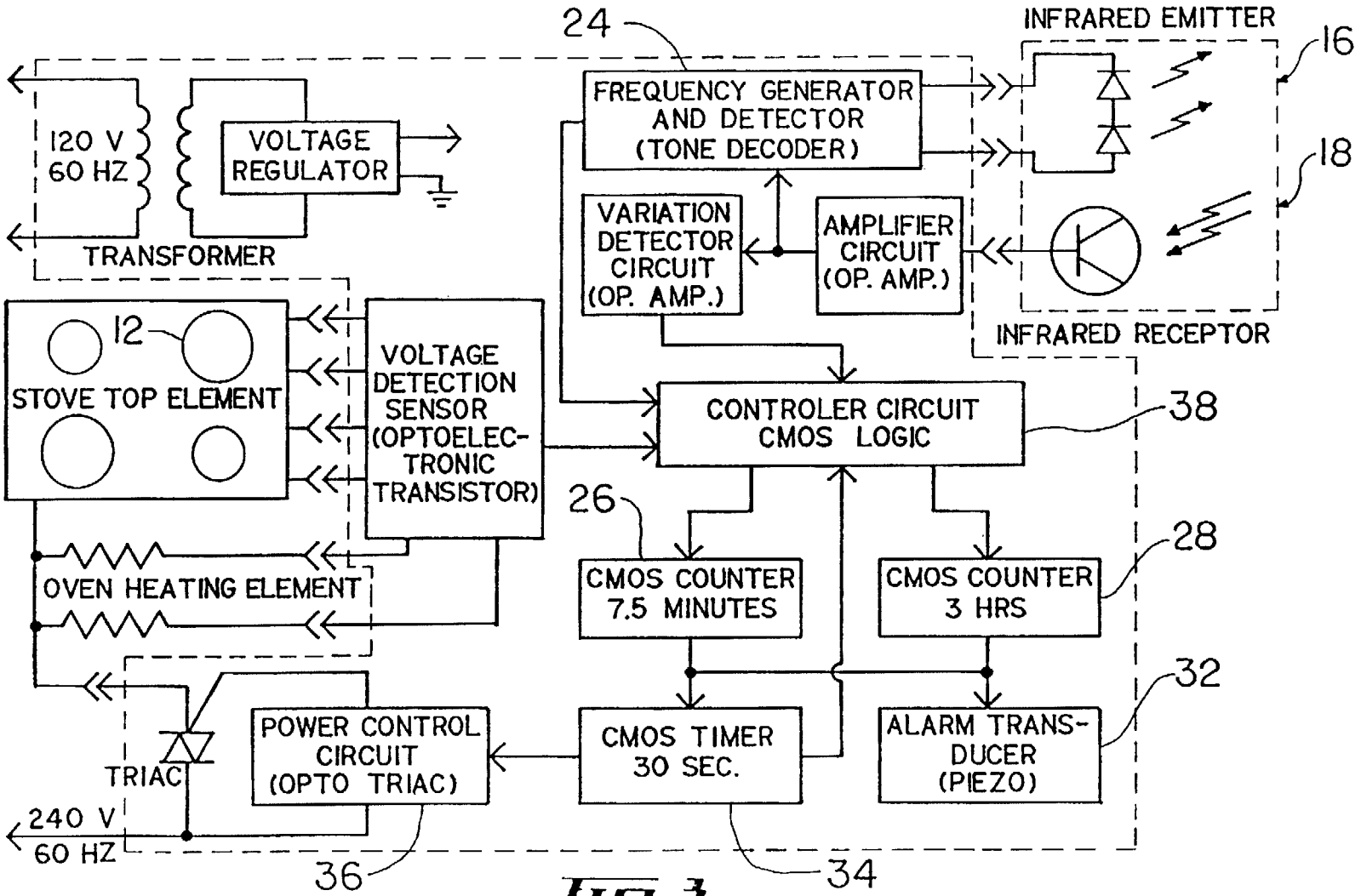
FIG. 3 is a block diagram showing operation of the safety device.

An electrical schematic is illustrated in FIG. 3 and as may be seen, a controller circuit 38 receives input from the infrared receptors and also a voltage detection sensor (different voltages being used for the stove top and the oven) and from the third timer which is activated following the operation of the alarm.

Figure 4:
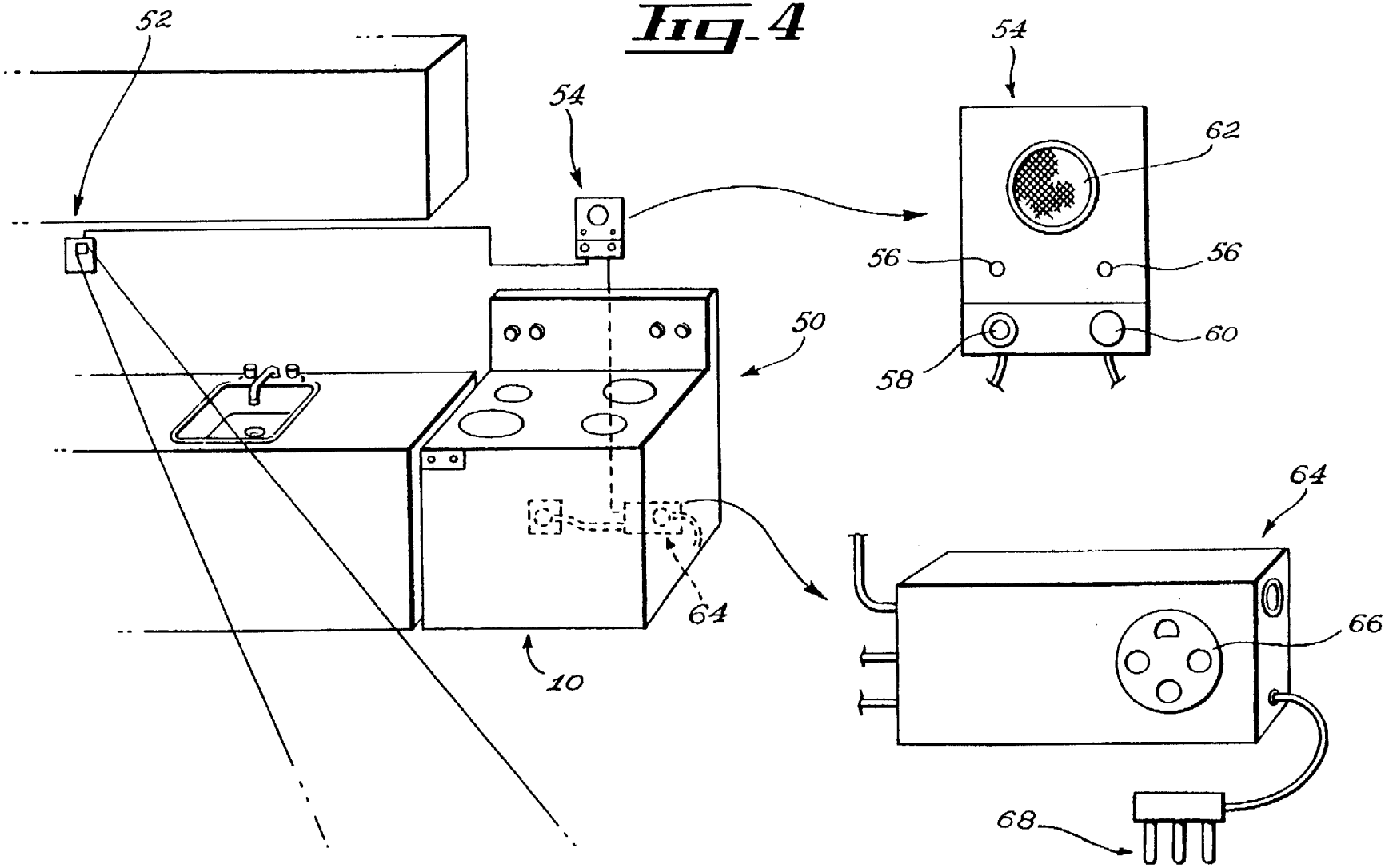
FIG. 4 is a perspective view illustrating adaption of the invention to an existing stove.

A variation of the invention is illustrated in FIG. 4 wherein the device can be adapted to existing setups. In this instance, there is illustrated an oven 50 and a sensor module 52 adapted to function by emitting and receiving a signal as previously discussed.

A monitoring module 54 is operatively connected to sensor module 52 and a control module 64. Monitoring module 54 may include LEDs 56 indicating the status thereof. In addition, monitoring module 54 may include a reset button 58, a time adjustment knob 60 and an alarm 62.

Control module 64 would include the control circuitry and in the illustrated embodiment, includes a plug receptacle 66 to receive the plug from the stove 50 while it itself has a module plug 68.

It will be understood that the above described embodiments are for purposes of illustration only and that changes and modifications may be made thereto without departing from the spirit and scope of the invention.

I claim:

1. A safety device for a stove being in an operational condition providing heat, said device comprising in combination:

means for presence detecting within a predetermined area, said presence detecting means being subjected to three conditions to be valid, namely that the presence is to have a sufficient size and that said presence detecting means further comprise means to emit a signal and means to receive a signal reflected by said presence, and motion detecting means;

said safety device further comprising:

means for reducing said heat, actuated by said presence detecting means, timer means linked to said presence detecting means and to said means for reducing heat, said timer means providing a predetermined time delay, means for operation detecting of said operational condition of said stove;

said means for reducing heat being triggered when said means for presence detecting fail to detect said presence corresponding to said three conditions, in said predetermined time delay, and said means for operation detecting sense said operational condition.

2. The safety device of claim 1 wherein said timer means are operatively connected so that after a presence meeting said three conditions is detected, said timer means are reset and said means for reducing heat stay off.

3. The safety device of claim 2 wherein said means for presence detecting comprise infrared sensing means.

4. The safety device of claim 2 wherein said means for presence detecting comprise ultrasonic sensing means.

5. The safety device of claim 2 wherein said stove comprises a number of surface elements and an oven.

6. The safety device of claim 5 wherein said predetermined time delay is variable according to said operational condition.

7. The safety device of claim 6 wherein said predetermined time delay is a short time of 5 to 10 minutes at a high heat level, an intermediate time of 30 to 60 minutes at a medium level and a long time of 3 to 8 hours at a low level, said means for operation detecting being connected to said surface element and said high level corresponding to 70–100% of a heat rating of said surface element, a medium level being 30 to 70% and a low level being 0 to 30%, said predetermined time being inversely proportional to a power level of said surface element.

* * * * *